US011306934B2

(12) United States Patent
Hamada et al.

(10) Patent No.: US 11,306,934 B2
(45) Date of Patent: Apr. 19, 2022

(54) AIR-CONDITIONING SYSTEM CONTROL APPARATUS USING DEGREE OF INFLUENCE BETWEEN AIR-CONDITIONING INDOOR UNITS

(71) Applicant: Mitsubishi Electric Corporation, Tokyo (JP)

(72) Inventors: Kazuki Hamada, Tokyo (JP); Tomoo Nakano, Tokyo (JP); Nobuaki Tasaki, Tokyo (JP); Yasuomi Ando, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 41 days.

(21) Appl. No.: 16/627,467

(22) PCT Filed: Aug. 30, 2017

(86) PCT No.: PCT/JP2017/031170
§ 371 (c)(1),
(2) Date: Dec. 30, 2019

(87) PCT Pub. No.: WO2019/043834
PCT Pub. Date: Mar. 7, 2019

(65) Prior Publication Data

US 2021/0003304 A1 Jan. 7, 2021

(51) Int. Cl.
*F24F 11/30* (2018.01)
*F24F 11/64* (2018.01)
(Continued)

(52) U.S. Cl.
CPC ..... *F24F 11/30* (2018.01); *F24F 11/64* (2018.01); *F24F 11/65* (2018.01);
(Continued)

(58) Field of Classification Search
None
See application file for complete search history.

(56) References Cited

U.S. PATENT DOCUMENTS 4,711,394 A 12/1987 Samuel
2014/0223941 A1 8/2014 Nishimura et al.
(Continued)

FOREIGN PATENT DOCUMENTS

JP 2006-226578 A 8/2006
JP 2010-145070 A 7/2010
(Continued)

OTHER PUBLICATIONS

International Search Report of the International Searching Authority dated Nov. 14, 2017 in corresponding International Patent Application No. PCT/JP2017/031170 (and English translation).
(Continued)

*Primary Examiner* — Nathan L Laughlin
(74) *Attorney, Agent, or Firm* — Posz Law Group, PLC

(57) ABSTRACT

The air-conditioning system control apparatus includes an influence-degree calculation unit that calculates a degree of influence between two air-conditioning indoor units that are selected from a plurality of air-conditioning indoor units as a pair of air-conditioning indoor units, based on operation data on the pair of air-conditioning indoor units.

17 Claims, 6 Drawing Sheets

(51) Int. Cl.

| | |
|---|---|
| *F24F 110/20* | (2018.01) |
| *F24F 140/60* | (2018.01) |
| *F24F 11/65* | (2018.01) |
| *F24F 110/10* | (2018.01) |

(52) U.S. Cl.
CPC ..... *F24F 2110/10* (2018.01); *F24F 2110/20* (2018.01); *F24F 2140/60* (2018.01)

(56) References Cited

U.S. PATENT DOCUMENTS

| | | | | |
|---|---|---|---|---|
| 2014/0277768 | A1* | 9/2014 | Watts | G05D 23/1905 700/278 |
| 2016/0029459 | A1* | 1/2016 | Ushirosako | H05B 47/105 315/297 |
| 2020/0134891 | A1* | 4/2020 | Ohta | F24F 11/52 |

FOREIGN PATENT DOCUMENTS

| | | | |
|---|---|---|---|
| JP | 2013-076531 | A | 4/2013 |
| JP | 2013-134019 | A | 7/2013 |
| JP | 2013-148304 | A | 8/2013 |
| JP | 2014-134299 | A | 7/2014 |
| JP | 2014-149117 | A | 8/2014 |
| JP | 2015-210062 | A | 11/2015 |
| JP | 2016-011779 | A | 1/2016 |

OTHER PUBLICATIONS

Chinese Office Action dated Dec. 22, 2020, issued in corresponding CN Patent Application No. 201780094097.9 (and English Machine Translation).

* cited by examiner

AIR-CONDITIONING SYSTEM CONTROL APPARATUS USING DEGREE OF INFLUENCE BETWEEN AIR-CONDITIONING INDOOR UNITS

CROSS REFERENCE TO RELATED APPLICATION

This application is a U.S. national stage application of PCT/JP2017/031170 filed on Aug. 30, 2017, the contents of which are incorporated herein by reference.

TECHNICAL FIELD

The present invention relates to an air-conditioning system control apparatus that controls various devices included in an air-conditioning system.

BACKGROUND ART

In the past, an air-conditioning system in which a plurality of air-conditioning indoor units are provided in the same space has been known. Patent Literature 1 discloses an air-conditioning system including a plurality of air-conditioning indoor units each provided with a light emitting and receiving device that emits and receives light. In the technique of Patent Literature 1, each of the air-conditioning indoor units emits and receives light to measure the distance between each air-conditioning indoor unit and the other air-conditioning indoor unit or units, and calculates the degree of influence between those air-conditioning indoor units based on the result of the measurement.

CITATION LIST

Patent Literature

Patent Literature 1: Japanese Unexamined Patent Application Publication No. 2006-226578

SUMMARY OF INVENTION

Technical Problem

The air-conditioning system disclosed in Patent Literature 1 needs to include the light emitting and receiving device as an additional component in order to calculate the degree of influence between the air-conditioning indoor units.

The present invention has been made to solve the above problem, and an object of the invention is to provide an air-conditioning system control apparatus capable of calculating the degree of influence between the air-conditioning indoor units without a specific device.

Solution to Problem

An air-conditioning system control apparatus according to an embodiment of the present invention includes an influence-degree calculation unit that calculates a degree of influence between two air-conditioning indoor units that are selected from a plurality of air-conditioning indoor units as a pair of air-conditioning indoor units, based on operation data on the pair of air-conditioning indoor units.

Advantageous Effects of Invention

According to the embodiment of the present invention, the degree of influence between the pair of air-conditioning indoor units is calculated based on operation data on the pair of air-conditioning indoor units. It is therefore possible to calculate the degree of influence between the air-conditioning indoor units without a specific device.

DESCRIPTION OF EMBODIMENTS

Embodiment 1

Figure 1:
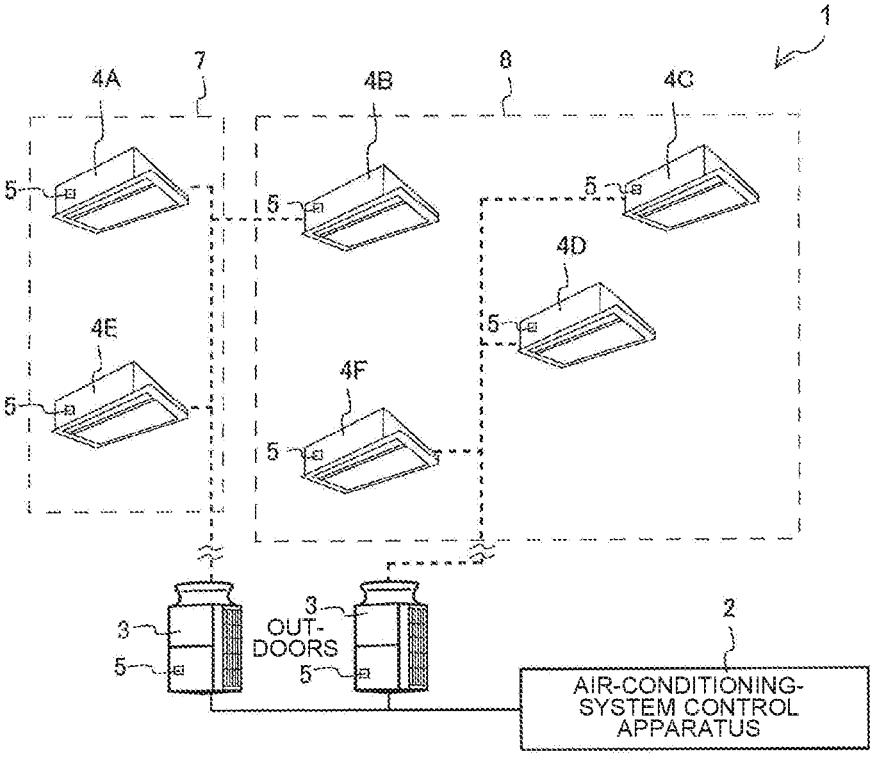
FIG. 1 is a block diagram of an air-conditioning system 1 according to Embodiment 1 of the present invention.

Embodiments of an air-conditioning system control apparatus according to the present invention will be described with reference to the drawings. FIG. 1 is a block diagram of an air-conditioning system 1 according to Embodiment 1 of the present invention. The air-conditioning system 1 as illustrated in FIG. 1 includes at least one air-conditioning outdoor unit 3, a plurality of air-conditioning indoor units 4, a plurality of sensors 5, and an air-conditioning system control apparatus 2. The air-conditioning system 1 according to Embodiment 1, as illustrated in FIG. 1, includes two air-conditioning outdoor units 3 and six air-conditioning indoor units 4A, 4B, 4C, 4D, 4E, and 4F. This, however, is an example. In the following description, the air-conditioning indoor units 4A, 4B, 4C, 4D, 4E, and 4F may be collectively referred to as the air-conditioning indoor units 4. One of the two air-conditioning outdoor units 3 is connected to the air-conditioning indoor units 4A to 4C by refrigerant pipes and communication lines, and the other is connected to the air-conditioning indoor units 4D to 4F by refrigerant pipes and communication lines. It should be noted that that the relationship in connection between the air-conditioning outdoor units 3 and the refrigerant pipes may be different from that between the air-conditioning outdoor units 3 and the communication lines. Furthermore, although it is illustrated by way of example that in the air-conditioning indoor units 4A, 4B, 4C, 4D, 4E, and 4F and the air-conditioning outdoor units 3, respective sensors 5 are provided, the sensors 5 may be provided outside the air-conditioning indoor units 4A, 4B, 4C, 4D, 4E, and 4F and the air-conditioning outdoor units 3.

Of the six air-conditioning indoor units 4A to 4F, two air-conditioning indoor units 4A and 4E are installed in a first space 7, and four air-conditioning indoor units 4B, 4C, 4D, and 4F are installed in a second space 8. One of the two air-conditioning outdoor units 3 is connected to the two air-conditioning indoor units 4A and 4E provided in the first space 7 and one air-conditioning indoor unit 4B provided in the second space 8, and the other is connected to the three air-conditioning indoor units 4C, 4D, and 4E provided in the second space 8.

In the air-conditioning system 1 according to Embodiment 1, air-conditioning indoor units 4 connected to the same air-conditioning outdoor unit 3 may be all installed in the same space or may be provided in different spaces. Furthermore, air-conditioning indoor units 4 connected to different air-conditioning outdoor units 3 may also be provided in the same space. With respect to Embodiment 1, it is illustrated by way of example in FIG. 1 that two spaces are provided, but the number of spaces may be one or may be three or more.

Figure 2:
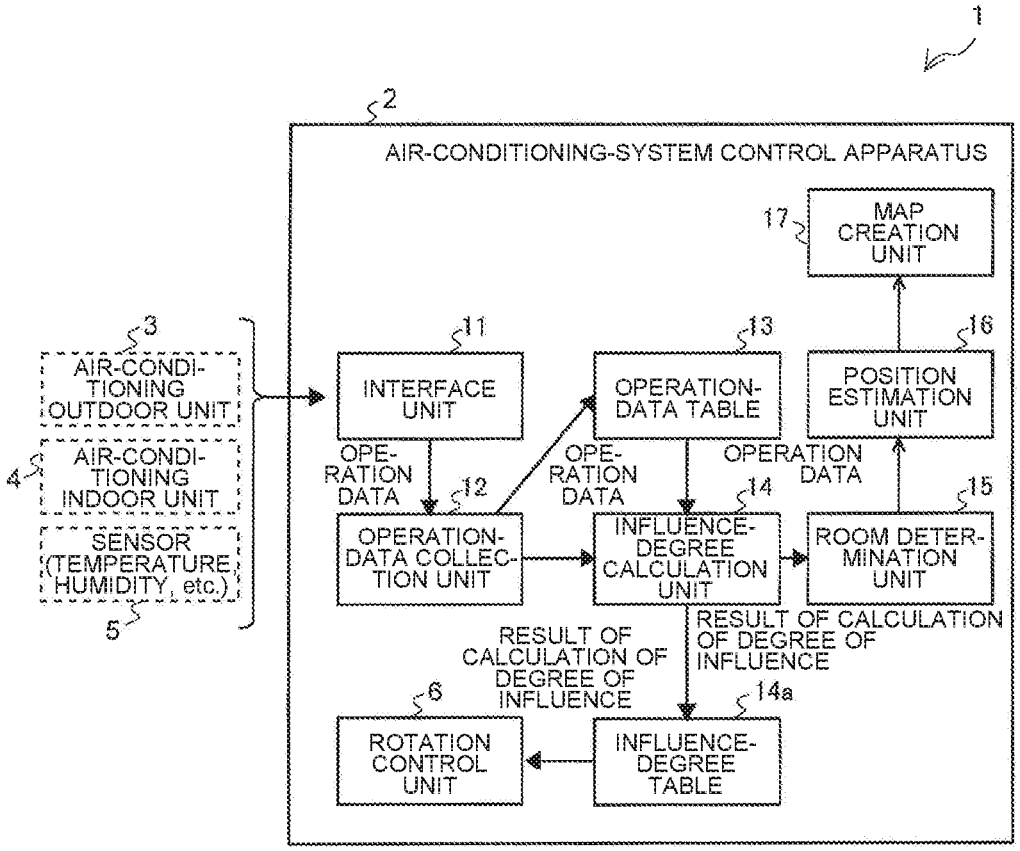
FIG. 2 is a block diagram of an air-conditioning system control apparatus 2 according to Embodiment 1 of the present invention.

FIG. 2 is a block diagram of the air-conditioning system control apparatus 2 according to Embodiment 1 of the present invention. As illustrated in FIG. 2, the air-conditioning system control apparatus 2 is a microcomputer that executes a plurality of programs. The air-conditioning system control apparatus 2 includes an interface unit 11, an operation data collection unit 12, an operation data table 13, an influence-degree calculation unit 14, a room determination unit 15, a position estimation unit 16, a map creation unit 17, an influence-degree table 14*a*, and a rotation control unit 6. The interface unit 11 receives operation data from the air-conditioning outdoor units 3, the air-conditioning indoor units 4, the sensors 5 and other components. The operation data collection unit 12 receives the operation data from the interface unit 11. In other words, the operation data collection unit 12 collects via the interface unit 11, the operation data from the air-conditioning outdoor units 3, the air-conditioning indoor units 4, the sensors 5 and other components that are all included in the air-conditioning system 1.

The operation data indicates information that can be collected from the air-conditioning system 1, and that indicates operating conditions such as an operation state, that is, whether an air-conditioning indoor unit is in operation or in a stopped state, an operation mode, a wind speed and a wind direction, and detection values obtained by the sensors 5. The operation data is collected not only when the air-conditioning indoor unit is in operation, but when the air-conditioning indoor unit is in the stopped state. The operation data table 13 is a storage unit that stores the operation data. The operation data collection unit 12 stores the collected operation data in the operation data table 13.

The influence-degree calculation unit 14 obtains the operation data from the operation data table 13, and calculates a degree of influence. The degree of influence is the degree to which one of the plurality of air-conditioning indoor units 4 is influenced by another one of the plurality of air-conditioning indoor units 4. Specifically, the influence-degree calculation unit 14 calculates a degree of influence between two air-conditioning apparatuses that are selected from the plurality of air-conditioning indoor units 4 as a pair of air-conditioning indoor units, based on operation data on the two air-conditioning apparatuses. For example, the influence-degree calculation unit 14 selects the air-conditioning indoor units 4A and 4B from the air-conditioning indoor units 4A to 4F, and calculates a degree of influence between the air-conditioning indoor units 4A and 4B based on the operation data on the air-conditioning indoor units 4A and 4B. Then, the influence-degree calculation unit 14 selects the air-conditioning indoor units 4A and 4C, and calculates a degree of influence between the air-conditioning indoor units 4A and 4C based on the operation data on the air-conditioning indoor units 4A and 4C. In such a manner, the influence-degree calculation unit 14 calculates a degree of influence between the air-conditioning indoor units of each of all possible combinations of the air-conditioning indoor units 4A to 4F. That is, the degrees of influence between all pairs of air-conditioning indoor units are calculated.

To be more specific, the influence-degree calculation unit 14 calculates a degree of influence using temporal correlation based on obtained operation data. A parameter indicating the temporal correlation is a parameter correlated with the distance between a pair of air-conditioning indoor units. The parameter indicating the temporal correlation is a change pattern of a suction temperature. The higher the degree of similarity in temporal change of the suction temperature between a pair of air-conditioning indoor units, the higher the degree of influence between the air-conditioning indoor units, and the higher the possibility with which the degree of influence between the air-conditioning indoor units is higher than that between another pair of air-conditioning indoor units. Therefore, as the degree of influence between a pair of air-conditioning indoor units, the degree of similarity in temporal change of suction temperature data between the pair of air-conditioning indoor units can be applied.

It should be noted that the parameter indicating the temporal correlation may be a time interval pattern of thermo-on time and thermos-off time. The higher the degree of similarity in temporal change of thermo-on time and thermos-off time between a pair of air-conditioning indoor units, the higher the degree of influence between the pair of air-conditioning indoor units, and the higher the possibility with which the degree of influence between the pair of air-conditioning indoor units is higher than that between another pair of air-conditioning indoor units. Therefore, as the degree of influence between a pair of air-conditioning indoor units, the degree of similarity in the degree of similarity in time interval pattern of thermo-on time and thermos-off time between the pair of air-conditioning indoor units can be applied.

Furthermore, the parameter indicating the temporal correlation may be a value of a temperature change of one of a pair of air-conditioning indoor units, which is made when the one of the pair of air-conditioning indoor units is stopped while the other air-conditioning indoor unit is in operation. To be more specific, when an air-conditioning operation of an air-conditioning indoor unit 4 that is in operation influences a detection value obtained by the sensor 5 of an air-conditioning indoor unit 4 that is in the stopped state, it is assumed that the degree of influence between these two air-conditioning indoor units is higher than that between another pair of air-conditioning indoor units. In this case, for example, it is assumed that there is a high probability that the above former two air-conditioning indoor units are provided in the same space.

Also, when the temporal correlation between values obtained by two temperature sensors provided at a pair of air-conditioning indoor units is higher than that between values obtained by two temperature sensors provided at another the pair of air-conditioning indoor units, it is assumed that that the degree of influence of the former pair of air-conditioning indoor units is higher than that of the latter pair of air-conditioning indoor units. Therefore, as the degree of influence between a pair of air-conditioning indoor units, a value of a temperature change of one of the pair of air-conditioning indoor units that is made when the one of the pair of air-conditioning indoor units is stopped while the other of the pair of air-conditioning indoor units is in operation may be applied.

It is preferable that the influence-degree calculation unit 14 calculate the degree of influence between a pair of air-conditioning indoor units using a machine learning method. The degree of influence between air-conditioning indoor units 4 constantly changes due to external environmental factors such as the number of people who are present in a room and opening and closing of windows. In Embodiment 1, the influence-degree calculation unit 14 repeatedly stores and learns the calculated temporal correlation at all times or at regular intervals, and as a result can accurately recognize position information on the air-conditioning indoor units 4.

The room determination unit 15 determines whether a pair of air-conditioning indoor units are present in the same space or not based on the degree of influence calculated by the influence-degree calculation unit 14. For example, the room determination unit 15 determines whether the calculated degree of influence is higher than or equal to a first threshold. When determining that the calculated degree of influence is higher than or equal to the first threshold, the room determination unit 15 determines that that the pair of air-conditioning indoor units are present in the same space, and when determining that the calculated degree of influence is less than the first threshold, the room determination unit 15 determines that that the pair of air-conditioning indoor units are not present in the same space.

The room determination unit 15 determines whether, for example, the air-conditioning indoor units 4A and 4B are present in the same space, based on the degree of influence between the air-conditioning indoor units 4A and 4B. In Embodiment 1, the room determination unit 15 determines that the degree of influence between the air-conditioning indoor units 4A and 4B is less than the first threshold, and the air-conditioning indoor units 4A and 4B are not present in the same space. Also, the room determination unit 15 determines whether, for example, the air-conditioning indoor units 4A and 4E are present in the same space or not based on the degree of influence between the air-conditioning indoor units 4A and 4E. In Embodiment 1, the room determination unit 15 determines that the degree of influence between the air-conditioning indoor units 4A and 4E is higher than or equal to the first threshold, and accordingly the room determination unit 15 determines that the air-conditioning indoor units 4A and 4E are present in the same space. The room determination unit 15 makes the above determination regarding all possible combinations of the air-conditioning indoor units 4A to 4F. As a result, it is determined whether or not all air-conditioning indoor units 4A to 4F are present in the same space.

The position estimation unit 16 estimates, based on the degree of influence between a pair of air-conditioning indoor units that are determined to be present in the same space by the room determination unit 15, a positional relationship between the pair of air-conditioning indoor units. For example, the position estimation unit 16 estimates a distance by referring to the calculated degree of influence and a table stored in advance and indicating a relationship between the degree of influence and distance information. Based on the distances between all pairs of air-conditioning indoor units provided in the same space, the position estimation unit 16 estimates the positions of all air-conditioning indoor units 4 provided in the same space. It should be noted that in the relationship indicated by the table, the lower the degree of influence between a pair of air-conditioning indoor units, the greater the distance between the pair of air-conditioning indoor units, and the higher the degree of influence between the pair of air-conditioning indoor units, the smaller the distance between the pair of air-conditioning indoor units.

It should be noted that calculated degrees of influence are classified based on a plurality of second thresholds set for respective distances, and the position estimation unit 16 may estimate a positional relationship based on the classified degrees of influence. Thereby, the position estimation unit 16 estimates how far away a pair of air-conditioning indoor units that are in the same space are from each other. The position estimation unit 16 may use a larger number of parameters than the parameters which the room determination unit 15 uses to determine whether a pair of air-conditioning indoor units are present in the same space or not, to thereby determine a detailed positional relationship between the pair of air-conditioning indoor units.

The map creation unit 17 creates a two-dimensional location map of air-conditioning indoor units 4 that are present in the same space, based on the estimation of positions of the air-conditioning indoor units 4 present in the same space that is made by the position estimation unit 16. After the influence-degree calculation unit 14 calculates degrees of influence between all pairs of air-conditioning indoor units, the map creation unit 17 creates a list of air-conditioning indoor units 4 that are present in the same space. For example, the map creation unit 17 converts parameters regarding the degrees of influence into distance proximities, and based on obtained distance proximities between all the air-conditioning indoor units 4, plots installation locations of all air-conditioning indoor units 4 on a plane. Thus, the location map of the air-conditioning indoor units 4 present in the same space is automatically created in the air-conditioning system control apparatus 2. An algorithm for use in plotting the installation locations of the air-conditioning indoor units 4 on the plane based on the distance information regarding distances between the air-conditioning indoor units 4 is not limited to a specific one, and may be a general solution to a position determination problem.

To be more specific, the algorithm may be an algorithm for use in, for example, a position determination method in an ad-hoc network of, for example, wireless sensors or wireless terminals, using a graph theory. Alternatively, the algorithm may be a heuristic algorithm represented by a genetic algorithm. Still alternatively, the algorithm may be an algorithm using a recognition method.

The influence-degree table 14*a* is a storage unit that stores a degree of influence. The influence-degree calculation unit 14 stores a calculated degree of influence in the influence-degree table 14*a*. The rotation control unit 6 obtains the degree of influence from the influence-degree table 14*a*, and executes a rotation operation based on the degree of influence. In the rotation operation, one or some of the plurality of air-conditioning indoor units 4 are kept in operation, and the operation of the other or others of the plurality of air-conditioning indoor units 4 is stopped.

In Embodiment 1, the rotation control unit 6 is provided in the air-conditioning system control apparatus 2. This, however, is an example. Instead of the rotation control unit 6, an external module may be used. For example, the rotation control unit 6 keeps in operation one of air-conditioning indoor units 4 installed in the same space, and stops the operation of the other or others of the air-conditioning units. Then, after the elapse of a predetermined time period, the rotation control unit 6 stops the operation of one or some or all air-conditioning indoor units 4 that are in operation, and starts the operation of one or some or all air-conditioning indoor units 4 that is in the stopped state. In such a manner, the operations of the air-conditioning indoor units 4A to 4F are selectively stopped or started in rotation at regular intervals, thereby equalizing the operational loads on the air-conditioning indoor units to achieve energy savings, and uniformly air-conditioning a target space for air-conditioning.

Of the plurality of air-conditioning indoor units 4, one of air-conditioning units having the lowest degree of influence is stopped in operation. For example, in the second space 8 as indicated in FIG. 1, the air-conditioning indoor units 4C and 4F have the lowest degree of influence, and the rotation control unit 6 keeps the air-conditioning indoor unit 4C in operation, and stops the operation of the air-conditioning indoor unit 4F. In such a manner, the operation of one of the air-conditioning indoor units 4 having the lowest degree of influence is stopped, to thereby reduce the degree of a change in an air-conditioning environment that is made by stopping an air-conditioning indoor unit 4. It should be noted that in the case where as in the first space 7 as indicated in FIG. 1, two air-conditioning indoor units 4 are installed, one of the two air-conditioning indoor units 4, for example, the air-conditioning indoor unit 4A, is kept in operation, and the operation of the other air-conditioning indoor unit 4, for example, the air-conditioning indoor unit 4E, is stopped.

Furthermore, the rotation control unit 6 stops next an air-conditioning indoor unit 4 having the lowest degree of influence for an air-conditioning indoor unit 4 that is in the stopped state. For example, in the second space 8 as indicated in FIG. 1, when the air-conditioning indoor unit 4C is in operation, the rotation control unit 6 selects the air-conditioning indoor unit 4F, which has the lowest degree of influence for the air-conditioning indoor unit 4C, as an air-conditioning indoor unit 4 to be stopped next. Then, after the elapse of a predetermined time period, the rotation control unit 6 stops the operation of the air-conditioning indoor unit 4C and keeps the air-conditioning indoor unit 4F in operation. In such a manner, an air-conditioning indoor unit 4 having the lowest degree of influence for an air-conditioning indoor unit 4 that is in the stopped state is stopped next, to thereby also reduce the degree of a change in the air-conditioning environment that is made by stopping an air-conditioning indoor unit 4.

The rotation control unit 6 may continuously perform a control of stopping the operation of one of air-conditioning indoor units 4 of the plurality of air-conditioning indoor units 4 that have the lowest degree of influence, and then stopping the operation of an air-conditioning indoor unit 4 having the lowest degree of influence for the air-conditioning indoor unit 4 that is in the stopped state. In this case, it is possible to further reduce the degree of a change in the air-conditioning environment that is made by stopping an air-conditioning indoor unit 4. It should be noted that in Embodiment 1, the rotation control unit 6 performs the rotation operation based on the degree of influence between air-conditioning indoor units 4; however, the rotation control unit 6 may perform the rotation operation based on the positions of the air-conditioning indoor units 4.

Figure 3:
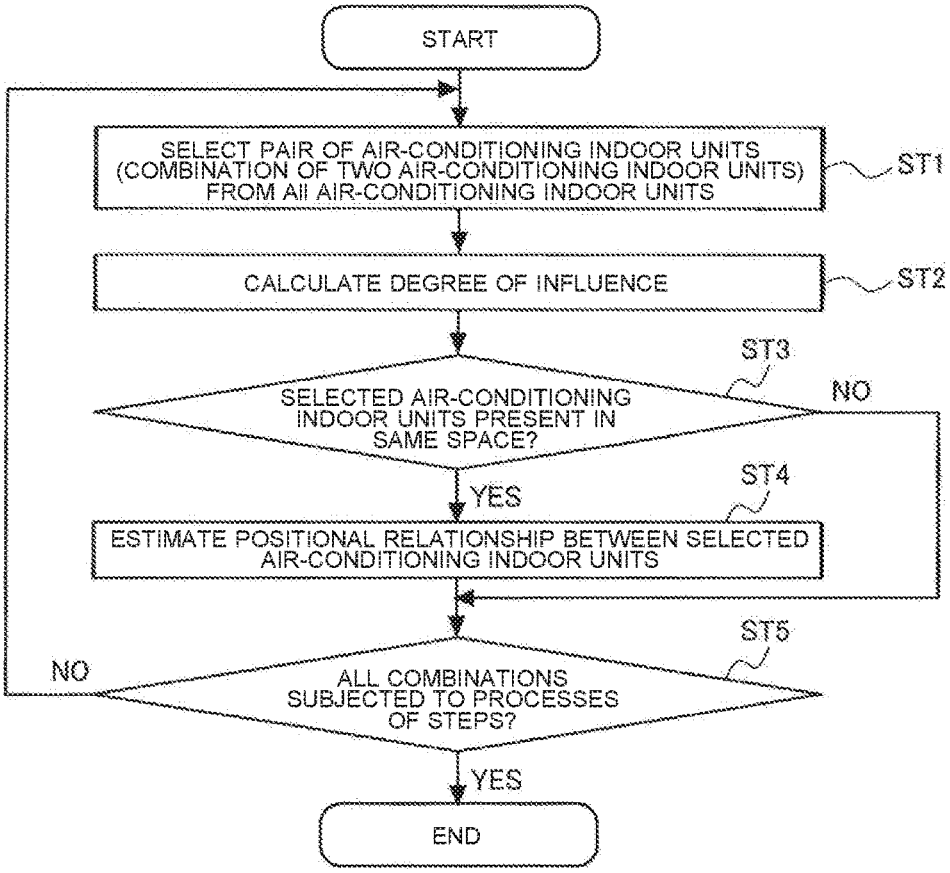
FIG. 3 is a flowchart of an operation of the air-conditioning system control apparatus 2 according to Embodiment 1 of the present invention.

FIG. 3 is a flowchart of an operation of the air-conditioning system control apparatus 2 according to Embodiment 1 of the present invention. Next, an operation of the air-conditioning system control apparatus 2 will be described. As illustrated in FIG. 3, first, two air-conditioning indoor units 4 are arbitrarily selected from a plurality of air-conditioning indoor units 4 as a pair of air-conditioning indoor units 4 (step ST1). Then, the influence-degree calculation unit 14 calculates a degree of influence between the pair of air-conditioning indoor units (step ST2). Based on the calculated degree of influence, the room determination unit 15 determines whether the pair of air-conditioning indoor units 4 are present in the same space or not (step ST3). When the pair of air-conditioning indoor units are not present in the same space (No in step ST3), the process proceeds to step ST5.

By contrast, when the pair of air-conditioning indoor units are present in the same space (Yes in step ST3), the position estimation unit 16 estimates a positional relationship between the pair of air-conditioning indoor units (step ST4). The above steps ST1 to ST4 are carried out for all possible combinations of the plurality of air-conditioning indoor units 4 (step ST5). Thus, a list of air-conditioning indoor units 4 present in the same space is created.

In Embodiment 1, the degree of influence between a pair of air-conditioning indoor units is calculated based on operation data on the pair of air-conditioning indoor units. Therefore, it is possible to calculate a degree of influence between the pair of air-conditioning indoor units 4 without a specific device such as an optical transmitting and receiving device. Furthermore, location information on the air-conditioning indoor units 4 on the plane can be obtained based on the degree of influence, and an energy-efficient control based on the location information can be performed to achieve energy saving. In Embodiment 1, the location information on the air-conditioning indoor units 4 is automatically obtained. Thus, when installing the air-conditioning system 1, for example, workers do not need to manually register the location information, and the burden on the worker in installation of the air-conditioning system 1 is thus reduced. Furthermore, in Embodiment 1, it is possible to provide additional functions and services, such as visualization of space information including the obtained location information, to a user who is present in space air-conditioned by the air-conditioning system 1 or an administrator for the space.

In Embodiment 1, the room determination unit 15 determines whether a pair of air-conditioning indoor units are present in the same space or not, and only when it is determined that the pair of air-conditioning indoor units are present in the same space, the position estimation unit 16 estimates how far away the pair of air-conditioning indoor units are from each other. That is, the air-conditioning system control apparatus 2 does not need to estimate the positions of the pair of air-conditioning indoor units when the pair of air-conditioning indoor units are not present in the same space. Therefore, the processing load on the air-conditioning system control apparatus 2 is reduced. The rotation control unit 6 maintains or stops operating of each of the air-conditioning indoor units 4. Thus, even if the operation of an air-conditioning indoor unit 4 is stopped, the air-conditioning environment is not greatly changed. That is, when the rotation operation is performed, the operation load is equalized to achieve energy savings, a target space for air-conditioning is uniformly air-conditioned, and the degree of the change of the air-conditioning environment is reduced.

Regarding Embodiment 1, it is described above by way of example that calculation is performed using a machine learning method. It will be described by way of example that machine learning is further promoted. The rotation control unit 6 keeps in operation, one of a pair of air-conditioning indoor units for which operation data is not sufficiently collected as compared with other pairs of air-conditioning indoor units, and stops the operation of the other of the above pair of air-conditioning indoor units. While an air-conditioning rotation control is being performed as in intermediate seasons, there is a case where operation data on a pair of air-conditioning indoor units has not been sufficiently collected. In this case, the rotation control unit 6 preferentially performs a control of keeping one of the above pair of air-conditioning indoor units in operation, and stopping the operation of the other of the pair of air-conditioning indoor units. Accordingly, the operation data collection unit 12 collects further operation data on the pair of air-conditioning indoor units. Thereby, the further operation data is added to the operation data insufficient to determine whether the pair of air-conditioning indoor units are present in the same space or not and estimate the degree of influence between the air-conditioning indoor units. It is therefore possible to improve the accuracy of calculation of the location information on the air-conditioning indoor units 4.

The following description is made by referring to by way of example the case where the air-conditioning indoor units 4 operate automatically (in an automatic mode). In this automatic operation, the user is allowed to set only limited items such as a temperature, and is not allowed to set detailed items such as an air rate. To the extent that the user's settings are satisfied, the automatic operation is performed in a manner suitable for calculation of location information, to thereby early improve the accuracy in calculation of the degree of influence. For example, the rotation control unit 6 keeps in operation, one of two air-conditioning indoor units 4 that are assumed adjacent to each other and stops the operation of the other of the two air-conditioning unit 4. Thereby, further operation data is added to the insufficient operation data, thus improving the accuracy in calculation of the degree of influence.

Embodiment 2

Figure 4:
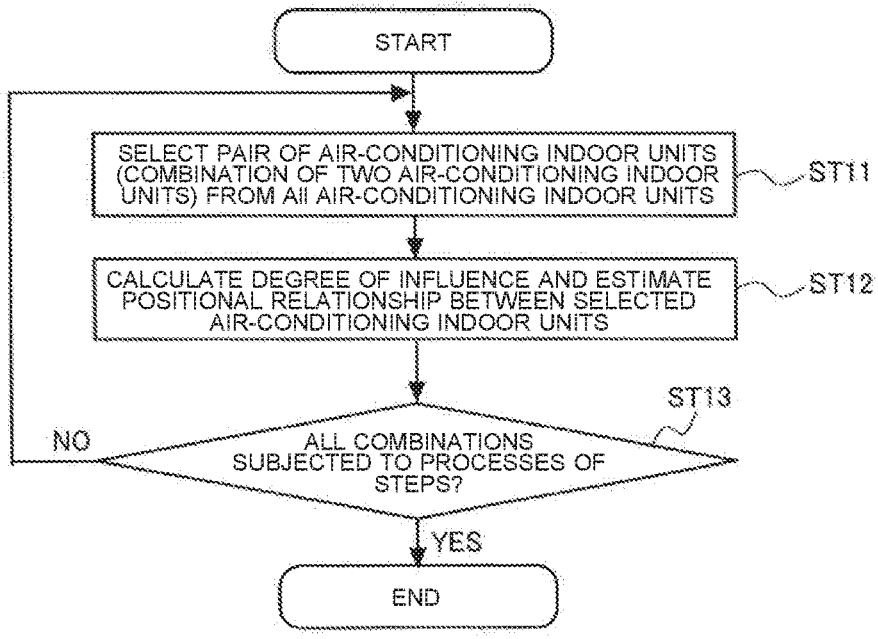
FIG. 4 is a flowchart of an operation of an air-conditioning system control apparatus 2 according to Embodiment 2 of the present invention.

FIG. 4 is a flowchart of an operation of the air-conditioning system control apparatus 2 according to Embodiment 2 of the present invention. In Embodiment 2, it is not determined whether a pair of air-conditioning indoor units are present in the same space. In this regard, Embodiment 2 is different from Embodiment 1. Regarding Embodiment 2, components that are the same as those in Embodiment 1 will be denoted by the same reference signs, and their descriptions will thus be omitted. Embodiment 2 will be described by mainly to the differences between Embodiments 1 and 2.

In Embodiment 2, it is not determined whether a pair of air-conditioning indoor units are present in the same space, and the degree of influence between air-conditioning indoor units of each of all possible combinations of the air-conditioning indoor units is calculated. As illustrated in FIG. 4, first, two air-conditioning indoor units 4 are arbitrarily selected from a plurality of air-conditioning indoor units 4 (step ST11). Then, the influence-degree calculation unit 14 calculates the degree of influence between the selected air-conditioning indoor units, and the position estimation unit 16 estimates a positional relationship between the air-conditioning indoor units based on the calculated degree of influence (step ST12). The above steps ST11 and ST12 are repeatedly carried out for all possible combinations of the plurality of air-conditioning indoor units 4 (step ST13). Thus, a list of air-conditioning indoor units 4 present in the same space is created.

As in Embodiment 2, also in the case where a positional relationship between a pair of air-conditioning indoor units is estimated regardless of whether they are present in the same space, it is possible to obtain the same advantages as in Embodiment 1.

Embodiment 3

Figure 5:
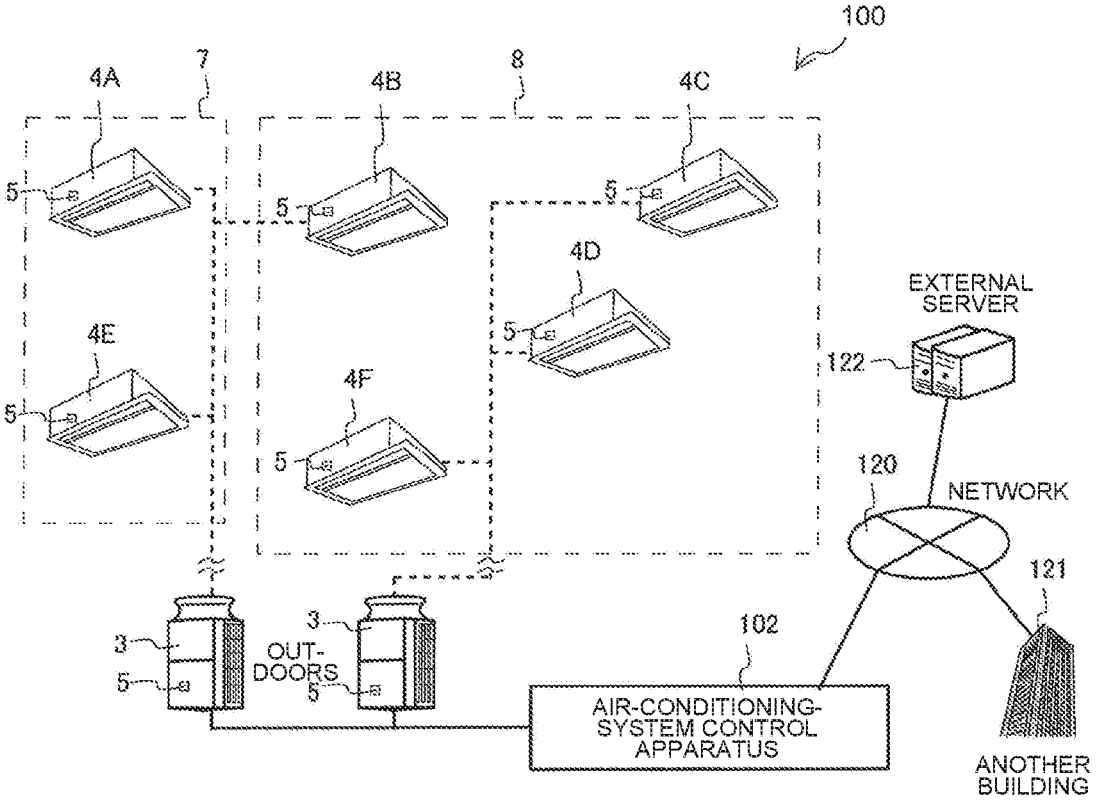
FIG. 5 is a block diagram of an air-conditioning system 100 according to Embodiment 3 of the present invention.

FIG. 5 is a block diagram of an air-conditioning system 100 according to Embodiment 3 of the present invention. In Embodiment 3, an air-conditioning system control apparatus 102 is connected to an external server 122 via a network 120. In this regard, Embodiment 3 is different from Embodiment 1. Embodiment 3 will be described by referring mainly to the differences between Embodiments 1 and 3. Regarding Embodiment 3, components that are the same as those in Embodiment 1 will be denoted by the same reference signs, and their descriptions will thus be omitted.

As illustrated in FIG. 5, the air-conditioning system control apparatus 102 is connected to the external server 122 and another building 121 via the network 120. It should be noted that the air-conditioning system 100 including the air-conditioning system control apparatus 102 is set in advance to have a floor map in which installation positions of the air-conditioning indoor units 4 are registered by, for example, a construction worker or workers. An air-conditioning system in another building 121 does not have such a floor map.

Figure 6:
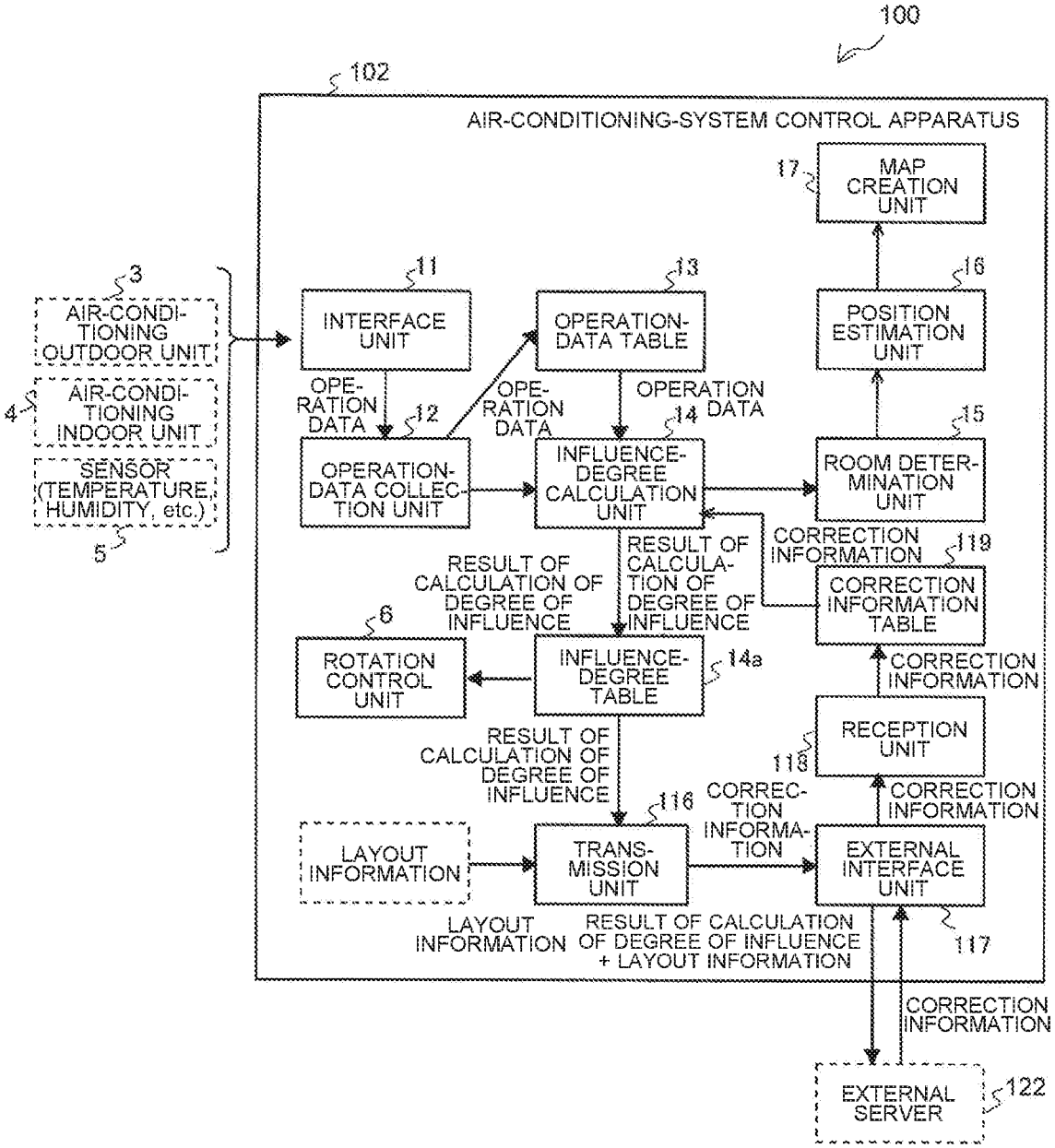
FIG. 6 is a block diagram of an air-conditioning system control apparatus 102 according to Embodiment 3 of the present invention.

FIG. 6 is a block diagram of the air-conditioning system control apparatus 102 according to Embodiment 3 of the present invention. As illustrated in FIG. 6, the air-conditioning system control apparatus 102 further includes a transmission unit 116, an external interface unit 117, a reception unit 118, and a correction information table 119.

The transmission unit 116 transmits data indicating a degree of influence that is obtained from the influence-degree table 14*a* and the floor map (layout information) to the external server 122 via the external interface unit 117. The external interface unit 117 transmits and receives data to and from the external server 122. The reception unit 118 receives correction information from the external server 122 via the external interface unit 117. The correction information table 119 is a storage unit that stores the correction information. The reception unit 118 stores the received correction information in the correction information table 119. The influence-degree calculation unit 14 obtains the correction information from the correction information table 119, and corrects the degree of influence. The external server 122 creates the correction information based on the received degree of influence.

Figure 7:
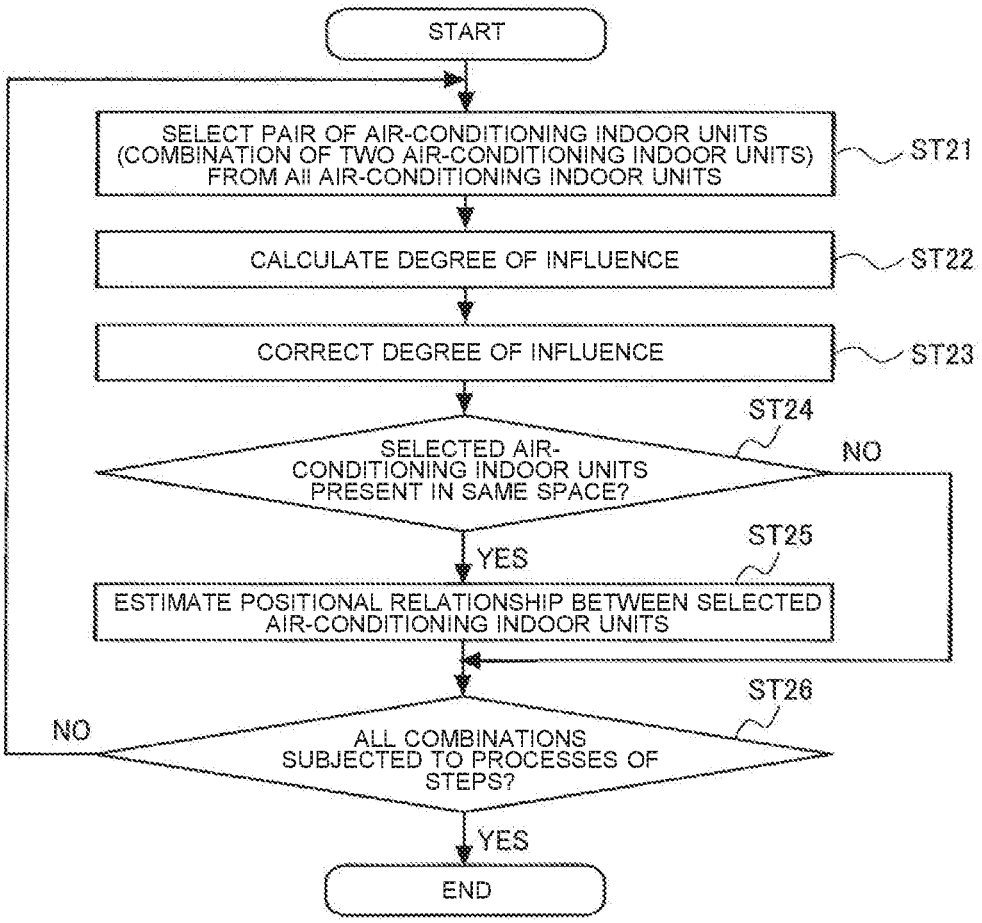
FIG. 7 is a flowchart of an operation of the air-conditioning system control apparatus 102 according to Embodiment 3 of the present invention.

FIG. 7 is a flowchart of an operation of the air-conditioning system control apparatus 102 according to Embodiment 3 of the present invention. As illustrated in FIG. 7, first, two air-conditioning indoor units 4 are arbitrarily selected from a plurality of air-conditioning indoor units 4 (step ST21). Then, the influence-degree calculation unit 14 calculates a degree of influence between the selected two air-conditioning indoor units (step ST22). From an external device having layout information, the layout information is obtained, and the degree of influence is corrected based on the layout information (step ST23). Based on the corrected degree of influence, the room determination unit 15 determines whether the two air-conditioning indoor units 4 are present in the same space or not (step ST24). When it is determined that the two air-conditioning indoor units are not present in the same space (No in step ST24), the process proceeds to step ST26.

When it is determined that the two air-conditioning indoor units are present in the same space (Yes in step ST24), the position estimation unit 16 estimates a positional relationship between the two air-conditioning indoor units (step ST25). The above steps ST21 to ST25 are repeatedly carried out for all possible combinations of the air-conditioning indoor units 4 (step ST26). Thus, a list of air-conditioning indoor units 4 present in the same space is created.

In Embodiment 3, the corrected information is transmitted from the air-conditioning system control apparatus 102 of the air-conditioning system 100 to the external server 122 via the network 120. The external server 122 transmits the received information to an air-conditioning system control apparatus for the other building 121. Based on the information transmitted from the external server 122, the air-conditioning system control apparatus for the other building 121 corrects a calculated degree of influence between the air-conditioning indoor units 4. In the other building 121, the calculated degree of influence is corrected based on a relationship between the transmitted floor map and the degree of influence, and the accuracy of calculation of the degree of influence can thus be improved. Thereby, it is possible to estimate the position based on the degree of influence with a higher accuracy.

REFERENCE SIGNS LIST

1 air-conditioning system, 2 air-conditioning system control apparatus, 3 air-conditioning outdoor unit, 4 air-conditioning indoor unit, sensor, 6 rotation control unit, 7 first space, 8 second space, 11 interface unit, 12 operation data collection unit, 13 operation data table, 14 influence-degree calculation unit, 14*a* influence-degree table, 15 room determination unit, 16 position estimation unit, 17 map creation unit, 100 air-conditioning system, 102 air-conditioning system control apparatus, 116 transmission unit, 117 external interface unit, 118 reception unit, 119 correction information table, 120 network, 121 another building, 122 external server

The invention claimed is:

1. An air-conditioning system control apparatus comprising:

an influence-degree calculation unit configured to calculate a degree of influence between air-conditioning indoor units that are selected from a plurality of air-conditioning indoor units, based on operation data on the selected air-conditioning indoor units;

a room determination unit configured to determine whether the selected air-conditioning indoor units are present in the same space or not based on the degree of influence calculated by the influence-degree calculation unit; and a position estimation unit configured to estimate a positional relationship between the selected air-conditioning indoor units, which are determined by the room determination unit to be present in the same space, based on the degree of influence between the selected air-conditioning indoor units;

wherein the air-conditioning system control apparatus automatically operates the selected air-conditioning indoor units based on the degree of influence and the positional relationship between the selected air-conditioning indoor units.

2. The air-conditioning system control apparatus of claim 1, wherein the selected air-conditioning indoor units are a pair of air-conditioning indoor units.

3. The air-conditioning system control apparatus of claim 2, further comprising a map creation unit configured to create a location map of the plurality of air-conditioning indoor units based on the positional relationship estimated by the position estimation unit.

4. The air-conditioning system control apparatus of claim 3, wherein the influence-degree calculation unit is configured to calculate degrees of influence between all possible pairs of air-conditioning indoor units of the plurality of air-conditioning indoor units, the position estimation unit is configured to estimate positional relationships between the all possible pairs of air-conditioning indoor units, and the map creation unit is configured to create a location map of all the plurality of air-conditioning indoor units based on the positional relationships between the all possible pairs of air-conditioning indoor units.

5. The air-conditioning system control apparatus of claim 4, wherein each of the positional relationships is a distance proximity between an associated pair of air-conditioning indoor units of the all possible pairs of air-conditioning indoor units, and the map creation unit is configured to plot positions of all the plurality of air-conditioning indoor units on a plane, based on distance proximities between the all possible pairs of air-conditioning indoor units.

6. The air-conditioning system control apparatus of claim 2, wherein the influence-degree calculation unit is configured to calculate the degree of influence between the pair of air-conditioning indoor units, using a machine learning method.

7. The air-conditioning system control apparatus of claim 2, wherein the influence-degree calculation unit is configured to calculate the degree of influence using a temporal correlation based on the operation data.

8. An air-conditioning system control apparatus comprising:

an influence-degree calculation unit configured to calculate a degree of influence between air-conditioning indoor units that are selected from a plurality of air-conditioning indoor units, based on operation data on the selected air-conditioning indoor units, wherein the degree of influence is a degree to which one of the plurality of air-conditioning indoor units is influenced by another one of the plurality of air-conditioning indoor units; and a rotation control unit configured to perform, based on the degree of influence calculated by the influence-degree calculation unit, a rotation operation in which one or some of the plurality of air-conditioning indoor units are kept in operation and an operation of a remaining one or ones of the plurality of air-conditioning indoor units is stopped, and also configured to stop an operation of one of air-conditioning indoor units that have the lowest degree of influence for each other among the plurality of air-conditioning indoor units.

9. The air-conditioning system control apparatus of claim 8, wherein the selected air-conditioning indoor units are a pair of air-conditioning indoor units.

10. The air-conditioning system control apparatus of claim 9, further comprising:

a room determination unit configured to determine whether the selected air-conditioning indoor units are present in the same space or not based on the degree of influence calculated by the influence-degree calculation unit;

a position estimation unit configured to estimate a positional relationship between the selected air-conditioning indoor units, which are determined by the room determination unit to be present in the same space, based on the degree of influence between the selected air-conditioning indoor units; and a map creation unit configured to create a location map of the plurality of air-conditioning indoor units based on the positional relationship estimated by the position estimation unit, wherein the rotation control unit is configured to stop an operation of one of two air-conditioning indoor units that are furthest away from each other on the location map created by the map creation unit, among the plurality of air-conditioning indoor units.

11. The air-conditioning system control apparatus of claim 9, wherein the rotation control unit is configured to stop next an operation of one of the plurality of air-conditioning indoor units that has the lowest degree of influence for another one of the plurality of air-conditioning indoor units that is in a stopped state.

12. The air-conditioning system control apparatus of claim 9, wherein the rotation control unit is configured to next stop an operation of one of the plurality of air-conditioning indoor units that is furthest from an other one of the plurality of air-conditioning indoor units that is in a stopped state, on a location map created by a map creation unit, among the plurality of air-conditioning indoor units.

13. The air-conditioning system control apparatus of claim 9, wherein the rotation control unit is configured to keep in operation, one of the pair of air-conditioning indoor units for which operation data is not sufficiently collected as compared with operation data on an other pair of air-conditioning indoor units, and stop an operation of an other of the pair of air-conditioning indoor units.

14. The air-conditioning system control apparatus of claim 9, wherein the rotation control unit is configured to keep in operation, when the plurality of air-conditioning indoor units are in automatic operation, one of the pair of air-conditioning indoor units for which operation data is not sufficiently collected as compared with operation data on an other pair of air-conditioning indoor units, and stop an operation of an other of the pair of air-conditioning indoor units.

15. An air-conditioning system control apparatus comprising an influence-degree calculation unit configured to calculate a degree of influence between air-conditioning indoor units that are selected from a plurality of air-conditioning indoor units, based on operation data on the selected air-conditioning indoor units, wherein the degree of influence is a degree of similarity in temporal change of suction temperature data between the selected air-conditioning indoor units, wherein the air-conditioning system control apparatus automatically operates the selected air-conditioning indoor units based on the calculated degree of influence.

16. The air-conditioning system control apparatus of claim 15, wherein the selected air-conditioning indoor units are a pair of air-conditioning indoor units.

17. The air-conditioning system control apparatus of claim 16, wherein the influence-degree calculation unit is configured to change the degree of influence such that the higher the similarity in temporal change of suction temperature data between the pair of air-conditioning indoor units, the higher the degree of influence.

* * * * *